United States Patent [19]

Robertson

[11] 3,938,782

[45] Feb. 17, 1976

[54] APPARATUS FOR PRODUCING A FOAMED FIBRE DISPERSION

[75] Inventor: Neil George Douglas Robertson, Marlow, England

[73] Assignee: Wiggins Teape Research & Development Limited, London, England

[22] Filed: Oct. 25, 1974

[21] Appl. No.: 518,187

Related U.S. Application Data

[63] Continuation-in-part of Ser. No. 347,561, April 3, 1973.

[30] Foreign Application Priority Data

Apr. 7, 1972 United Kingdom ..... 16210/72

[52] U.S. Cl. ..... 259/4 R; 425/4 R

[51] Int. Cl.[2] ..... B01F 15/02

[58] Field of Search ..... 259/4, 18, 36; 162/101, 162/202, 336; 261/DIG. 26; 252/359 E; 425/4; 239/343

[56] References Cited

UNITED STATES PATENTS

| | | | |
|---|---|---|---|
| 3,089,683 | 5/1963 | Thomas | 259/4 |
| 3,235,908 | 2/1966 | Thompson | 425/4 |
| 3,266,780 | 8/1966 | Waters | 259/4 |
| 3,296,066 | 1/1967 | Green | 162/343 |
| 3,486,862 | 12/1969 | Unterstenhoefer | 259/4 |
| 3,526,391 | 9/1970 | Church | 259/4 |
| 3,716,449 | 2/1973 | Gatward | 162/101 |

*Primary Examiner*—Robert W. Jenkins
*Attorney, Agent, or Firm*—Burns, Doane, Swecker & Mathis

[57] ABSTRACT

Apparatus for producing a foamed fibre dispersion for deposition on the foraminous support of a machine for manufacturing non-woven fibrous material includes an outlet manifold closed except for an outlet from which foamed fibre dispersion issues for deposition on the foraminous support, as well as a plurality of input openings, an inlet manifold closed except for an inlet through which the apparatus is supplied with dispersion to be foamed, and a plurality of outlet openings. A plurality of closed foam-forming pipes each effect communication between an individual one of the inlet manifold outlets and an individual one of the outlet manifold inlet openings. Each foam-forming pipe includes at least one internal region defined by zones of alternately decreasing and increasing cross section so as to establish cross sectional restriction to increase the speed of flow of dispersion, thereby to create in the foam-forming pipe turbulence to effect foaming of the dispersion. A pump is operable to pump a dispersion of air and fibres in a liquid containing a surface active agent into and through the inlet manifold, through the foam-forming pipes, and into and out of the outlet manifold.

23 Claims, 9 Drawing Figures

9
4
1
10
9
3

9
9
10
10
10
10
10
10
10
3
4
1
1
5
6
9
9

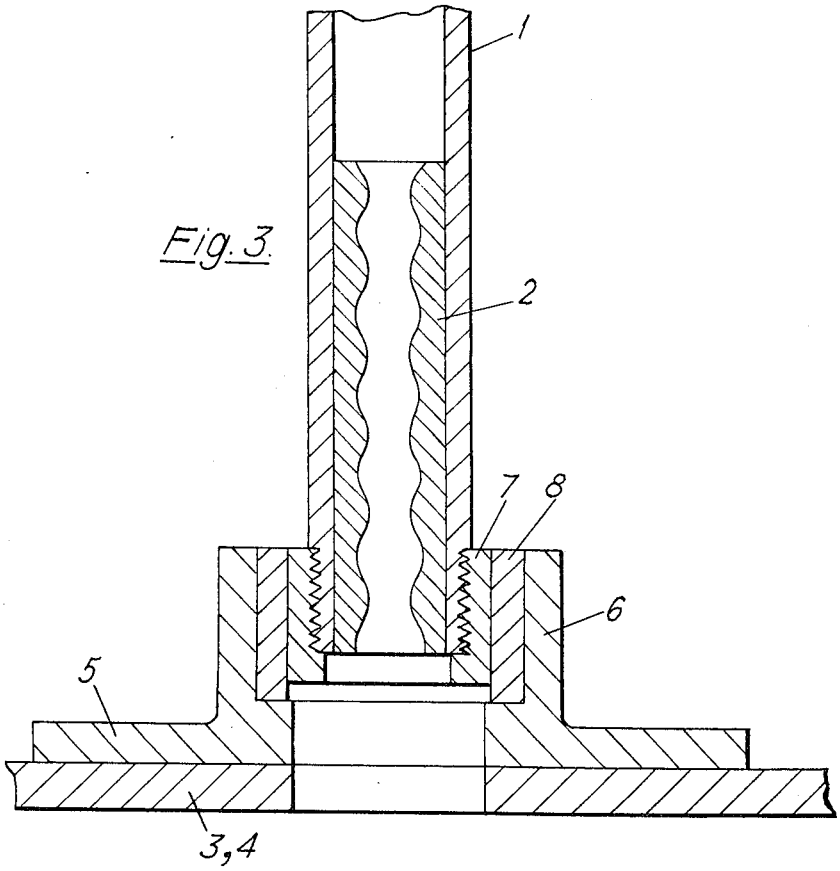
Fig. 3.
Fig. 6.
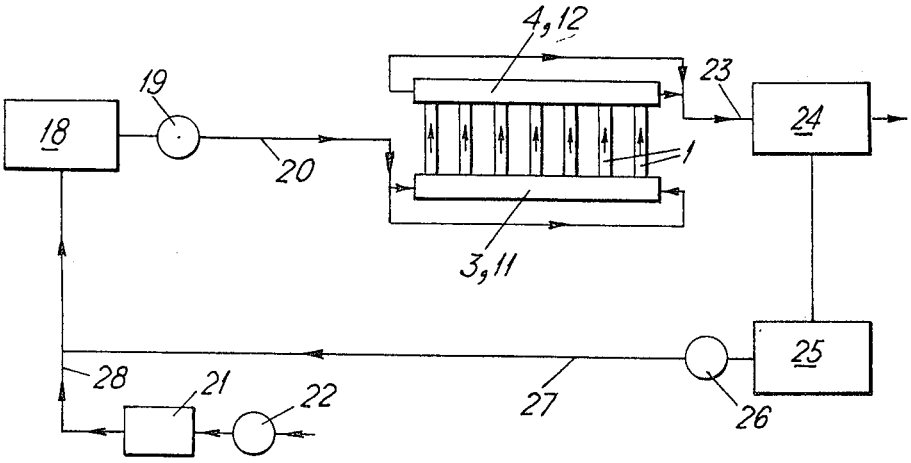

APPARATUS FOR PRODUCING A FOAMED FIBRE DISPERSION

BACKGROUND OF THE INVENTION

This application is a continuation-in-part of application Ser. No. 347,561, filed Apr. 3, 1973.

1. Field of the Invention

This invention relates to apparatus for producing a foamed fibre dispersion for use in the manufacture of non-woven fibrous material, including paper.

2. Description of the Prior Art

It is known to manufacture paper and other non-woven fibrous material by depositing a suspension of fibres in a liquid, usually water, onto a foraminous support, called the wire, of a paper-making machine, which allows the liquid to drain through while retaining most of the fibres in the form of a web in which the fibres lie intermeshed, all substantially in the plane of the web. Due to the random nature of the process of deposition, and also because of the natural tendency of most fibres to form flocs, or clumps, the web is usually not uniform but contains areas which are particularly thin or light, or which are particularly thick or heavy. The degree of uniformity, or the lack of uniformity, of the web, may be controlled to some extent by the exercise of the machine operator's skill and by the design of the machine. In particular, the formation of acceptably uniform webs from fibres which have an excessive tendency to flocculate, or clump together, such as long synthetic fibres, or long, lightly beaten cotton or wood fibres, or other long natural fibres from animal, vegetable or mineral sources, requires that the fibres be dispersed in very large volumes of liquid. The subsequent drainage of such large volumes of liquid cannot be accomplished on conventional paper-making machines but requires costly modifications thereto.

A less common known method of manufacturing fibrous material is that in which fibres are first dispersed in a liquid medium of high viscosity, such as an aqueous solution of sugar, or of natural gums, the dispersion then being drained through the wire of a paper-making machine thereby to form a fibrous web on the wire.

This method has the advantage that when the dispersing action ceases, the fibres very quickly cease their motion in the liquid medium, and become immobile before they can become flocculated and clumped together to any appreciable extent. Thus, the fibres in such a liquid medium remain well dispersed until the liquid medium is drained from the dispersion and the web formed. However, due to the always high viscosity of the liquid medium initial dispersion of fibres therein is difficult, and its drainage through the forming web and through the supporting wire is slow and difficult, so that this known method is not well suited to the large-scale continuous manufacture of fibrous material.

It has also been proposed to add a surface active agent to the water conventionally used in the waterlaying of fibrous webs on a paper-making machine, and by agitation produce a foamed fibre dispersion having an air content of at least 65 percent by volume to assist in the formation of a uniform fibrous web and, more especially, a uniform fibrous web comprising fibres longer than those conventionally employed in the water-laying manufacture of fibrous webs on a paper-making machine i.e. fibres having a length in excess of about 3 mm.

Known methods of forming such a foamed fibre dispersion involve subjecting water containing surface active agent to a vigorous shearing action, for example by the use of apparatus comprising a casing for containing the water, and an impeller mounted within the casing for rotation relative thereto such that the water is subjected to a vigorous shearing action between blades of the impeller and an inner surface of the casing. With the use of such apparatus fibres can be added either to the water prior to foaming thereof or to foam already formed in the apparatus.

Known foamed fibre dispersion forming apparatus as described above, while being effective to form dispersions having required properties, has the disadvantage that it comprises relatively moving parts, i.e., the impeller and the casing, and thus requires an input of power to provide the necessary movement. Further, the relative movement of the parts results in wear in the apparatus.

SUMMARY

It has now been discovered, firstly that fibrous material having a higher degree of uniformity of fibre dispersion throughout the material than can be produced at the same weight consistency using only water as the dispersion medium, can be manufactured using a foamed liquid medium having an air content above a lower limit less than 65 percent; secondly that there is an air content level for the foamed liquid medium above which although the dispersion of fibres in the foamed liquid medium is more uniform than can be obtained at the same weight consistency using only water as the dispersion medium, nevertheless the fibres in the foamed liquid medium have a tendency to agglomerate; and thirdly that the size distribution of the bubbles in the foamed liquid medium is of considerable importance.

It has also been discovered that not all foamed liquid media comprising gas bubbles dispersed in a liquid containing a surface active agent are useful for dispersing fibres, and in fact that certain foamed liquid media can be used to produce agglomeration of fibres (and particles) rather than dispersion thereof, albeit that the overall fibre dispersion may be better than could be obtained at the same weight consistency using water only as the dispersion medium.

It has further been discovered that an important parameter in relation to the dispersion/agglomeration properties of a foamed liquid medium of the kind under consideration is the volume percentage of gas therein, and that the possible volume percentage of gas range (i.e. 0 percent to about 99.9 percent) can be divided into three subranges two of which, namely up to about 55 percent and over about 75 percent, can be used to effect agglomeration of fibres and/or particles, and the other, namely from about 55 percent to about 75 percent, can be used to effect substantially uniform dispersion of generally discrete fibres.

The volume percentage of gas required to effect the most uniform dispersion of any particular fibres and/or particles is generally dependent upon the shape, size, physical properties and concentration of the fibres and/or particles. The relationship between the size of the fibres and/or particles and the arithmetic mean diameter of the gas bubbles is also relevant in determining the most uniform dispersion of any particular fibres and/or particles.

It has been ascertained that at all volume percentages of gas, fibres normally occupy only the liquid between the gas bubbles; that is that fibres do not penetrate the gas bubbles. Thus, factors determining whether a particular foamed liquid medium will effect dispersion or agglomeration of fibres apart from the volume percentage of gas therein are the number, shape and size of the gas bubbles in the medium.

When the foamed liquid medium contains a volume percentage of gas of between about 55 percent and 75 percent, the fibres are dispersed substantially, uniformly throughout the foamed liquid medium.

When the volume percentage of gas in a foamed liquid medium is less than about 55 percent, the gas is contained in a relatively few relatively wide diameter range bubbles which devide the medium into pockets of liquid in which the fibres collect, and as the viscosity of the liquid (normally water) is relatively low, the fibres are free to move and thus agglomerate within the liquid pockets.

When the volume percentage of gas in a foamed liquid medium is greater than about 75 percent and the bubbles have a substantially uniform size distribution, the packing density of the bubbles is so high that the bubbles are deformed from their normally spherical shape into polyhedrally shaped bubbles. In a medium containing such bubbles, surface tension effects result in forces in the planes of the inter-bubble lamellae, the forces being directed towards the line of intersection of the lamellae and into the points of intersection of the lines of intersection of the lamellae. These forces move fibres into the lines of intersection of the lamellae and the fibres become aligned in bundles in these lines.

However, although when using a foamed liquid medium having a volume percentage of gas above 75 percent therein there is some degree of fibre agglomeration, nevertheless the overall fibre dispersion in a web produced using such a foam can be better than can be obtained at the same fibre weight consistency using only water as the dispersion medium.

Work has shown that as the volume percentage of gas in a foamed liquid medium increases, firstly the number of bubbles per unit volume of the medium increases; secondly the arithmetic mean diameter of the bubbles decreases; and thirdly the range of bubble diameters decreases. The inherent desirable viscosity properties of the foamed liquid medium produced in accordance with the present invention derive from not only the number of bubbles therein per unit volume, but also from the substantially uniform size of the bubbles.

The effect on the viscosity of the medium of the bubble size distribution is thought to result from the fact that the volume percentage of gas required for close packing of the bubbles is less if the bubbles have a substantially uniform size distribution.

The chemical nature of the surface active agent used is not critical provided that it is able to produce a foamed liquid medium having the specified properties. The surface active agent may be anionic, cationic, or nonionic and it has been found that proprietary surface active agents such as that sold under the name "ACE" liquid, this being an anionic substance, by Industrial Soaps Ltd., that sold as "TEXTOFOR (Registered Trade Mark) FN 15", a nonionic substance, by Glover Chemicals Ltd., and that sold as "AMINE Fb 19", a cationic substance, by Float-Ore Ltd., are all suitable. Other surface active agents that have been used are octylphenoxypolyethoxy ethanol, and commercial grade dodecyl benzene sulfonate.

The arithmetic mean diameter of the bubbles in a foamed liquid medium can be determined by plunging a microscope slide cooled to about −70°C into the medium, and then removing the slide with a sample of the medium frozen thereto and placing the slide into a freezing stage of a microscope. Photomicrographs at say 100 × magnification can then be taken and the arithmetic mean diameter of the visible bubbles then determined therefrom. This method has the advantage that a sample of the medium is taken from within the medium mass, and it is not only the outer layer of bubbles that is examined.

It is an object of the present invention to provide an apparatus for producing a foamed fibre dispersion for use in the manufacture of non-woven fibrous material, which apparatus comprises no moving parts, and a further object is to combine with the apparatus means for controlling the production so as to produce foamed fibre dispersions having the desirable properties which follow from the discoveries described above.

According to the invention there is provided apparatus for producing a foamed fibre dispersion for use in the manufacture of non-woven fibrous material, said apparatus comprising a plurality of foam-forming pipes, and an inlet manifold and an outlet manifold connected one to the other by said pipes, the arrangement being such that by feeding, under pressure, a dispersion of air and fibres in a liquid containing a surface active agent into the inlet manifold and through the pipes a foamed fibrous dispersion is delivered to the outlet manifold. Each foam-forming pipe includes at least one internal region defined by zones of alternately decreasing and increasing cross section so as to establish cross sectional restriciton to increase the speed of flow of dispersion.

In use of apparatus according to the invention the fibre dispersion supplied to the inlet manifold passes into the foam-forming pipes through those regions defined by zones of alternately decreasing and increasing cross section, and then passes from the outlet manifold in a foamed condition. These regions of foam-forming pipes serve to create turbulent flow of the fibre dispersion before it passes along the foam-forming pipes, the dispersion thus becoming foamed, without the use of moving parts, during its passage along the foam-forming pipes. It has been found that the undulating cross sectional area changes provide a significant foam-forming advantage over the mere presence of a constriction to throttle flow.

Foam stability is considerably enhanced where the foam-forming pipes are each provided with a coiled section including at least two coils between the outlet manifold and the undulating sections.

An advantage of apparatus according to the invention is that it can be positioned in-line between a source of air and fibre dispersed in water containing surface active agent, and a foraminous support on which the foamed fibre dispersion formed in the apparatus is to be drained, without the need for any pumping means which could upset the characteristics of the foamed fibre dispersion, between the apparatus and the foraminous support. The foamed fibre dispersion can be fed straight from the apparatus of the invention on to the foraminous support by means of a mere flow spreader, for example a pipe shaped to spread the flow emanating from the apparatus to the width of the foraminous support, but is preferably fed by way of a conventional type of paper-making machine head box, closed or open.

A mixer connected to the inlet manifold can be arranged to effect an initial dispersion of air and fibres in liquid containing the surface active agent and metering means be connected with an inlet to the mixer to admit metered quantities of air to the mixer.

BRIEF DESCRIPTION OF THE DRAWINGS

FIG. 3 is a sectional view through a connection between the inlet manifold and a foam-forming pipe of the apparatus, FIG. 6 is a block diagram of a part of a nonwoven fibrous material manufacturing system including apparatus according to the invention.

DESCRIPTION OF THE PREFERRED EMBODIMENT

Figure 2:
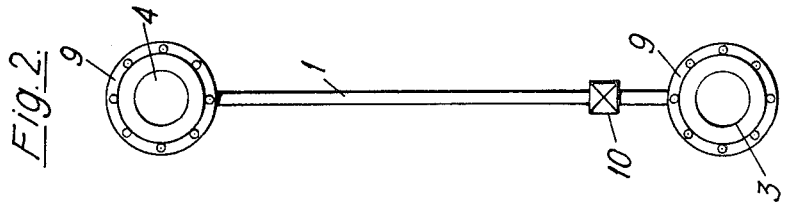
FIG. 2 is an end elevation of the apparatus of FIG. 1.
Figure 1:
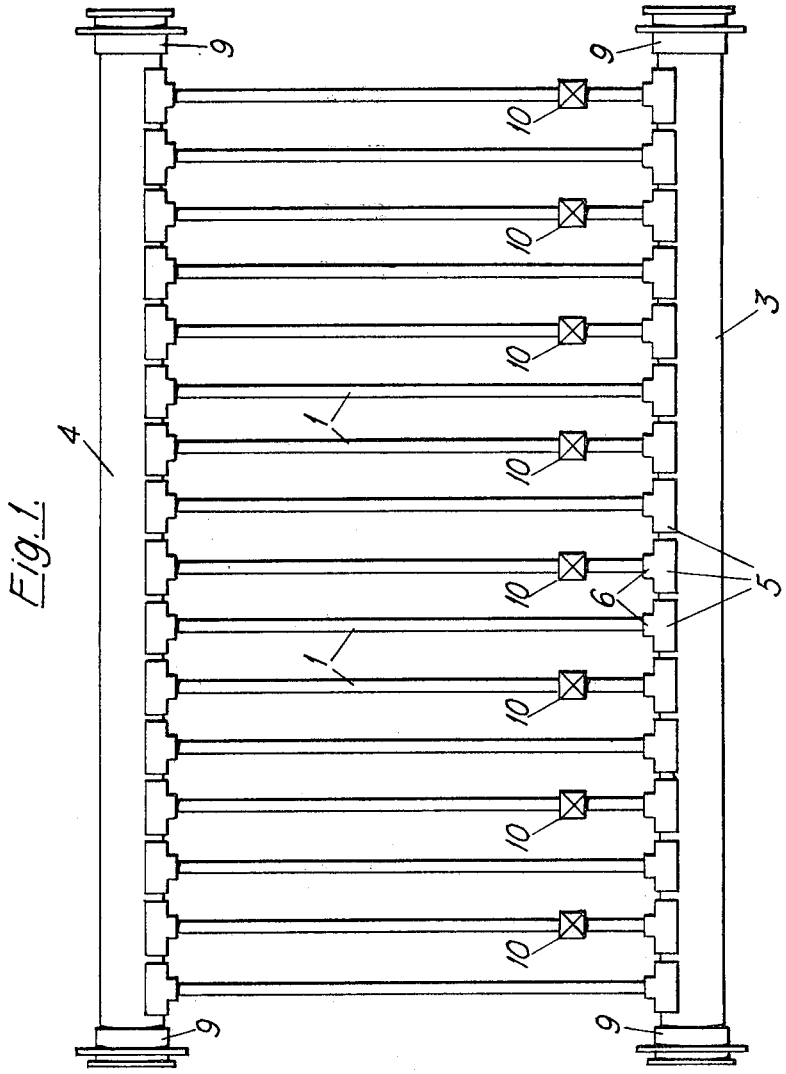
FIG. 1 is a plan view of one form of the apparatus.
Figure 7:
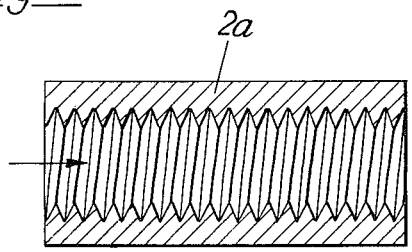
FIGS. 7–9 are cross-sectional views of alternative forms of pipe inserts that may be employed instead of the insert depicted in FIG. 5.
Figure 8:
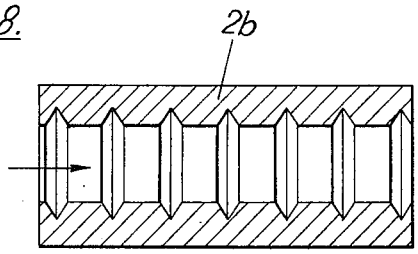
Figure 9:
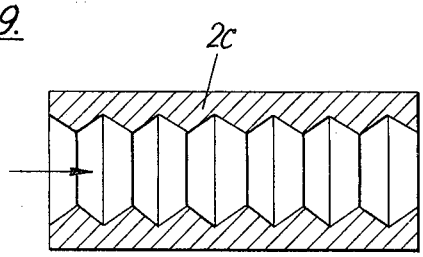

Referring to FIGS. 1 to 3, the apparatus comprises a plurality of foam-forming pipes 1 each having at least one internal region of constricted cross-section formed by a tubular insert 2. As clearly depicted in FIG. 5, this region is defined by zones of alternately decreasing and increasing cross-section. Such an undulating region has been found to provide a significant foam-forming advantage over the mere presence of a constriction to throttle flow. FIGS. 7–9 depict tubular inserts 2*a*, 2*b*, and 2*c* which may be employed in place of the insert 2 depicted in FIG. 5. As is apparent, these inserts of FIGS. 7–9 also provide an internal region of constricted cross-section defined by zones of alternately decreasing and increasing cross-section, which undulating regions also provide the aforementioned foam-forming advantages.

An inlet manifold, formed by an inlet pipe 3, and an outlet manifold formed by an outlet pipe 4, are connected one to the other by the foam-forming pipes 1.

The inlet pipes 3 and outlet pipes 4 may have an internal diameter of 6 inches for a flow of 3000 liters per minute, the foam-forming pipes an internal diameter of three-quarters of an inch, and the tubular insert an internal diameter of one-half of an inch. The foam-forming pipes 1, in this embodiment are straight pipes which extend between the inlet and outlet pipes 3, 4 in spaced substantially parallel relation, the length of the foam-forming pipes 1 being about ten feet and the spacing between the axes of the foam-forming pipes about six and one-quarter inches.

Bossed flanged members 5 are secured to each of the inlet and outlet pipes 3, 4 and one end of a foam-forming pipe 1 is located in the boss 6 of each said member as illustrated in FIG. 1. Each end of a foam-forming pipe is secured in its boss 6, as illustrated in FIG. 3, by two co-acting sleeves 7, 8 one within the other, the inner sleeve 7 being secured to the end of the pipe 1 and to the outer sleeve 8, and the outer sleeve 8 being secured to the boss 6.

Each end of each of the inlet and outlet pipes 3, 4 is provided with an apertured flange member 9 to connect the opposite ends of the pipes in common respectively to an input pipe and an output pipe, as described below.

Some of the foam-forming pipes 1, alternate ones as shown in FIG. 1, are provided with on/off valve 10 by which the through put of the apparatus can be controlled.

Figure 5:
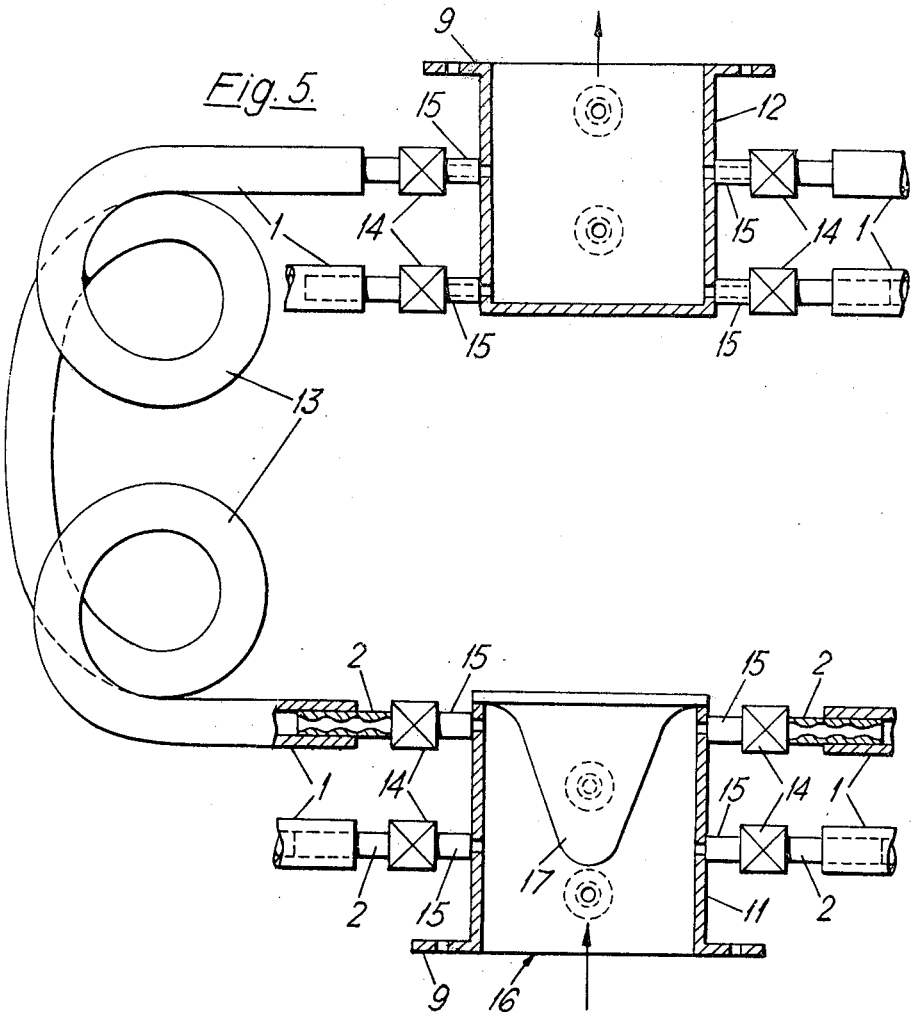
FIG. 5 is a section diagrammatically illustrating a part of the apparatus of FIG. 4.
Figure 4:
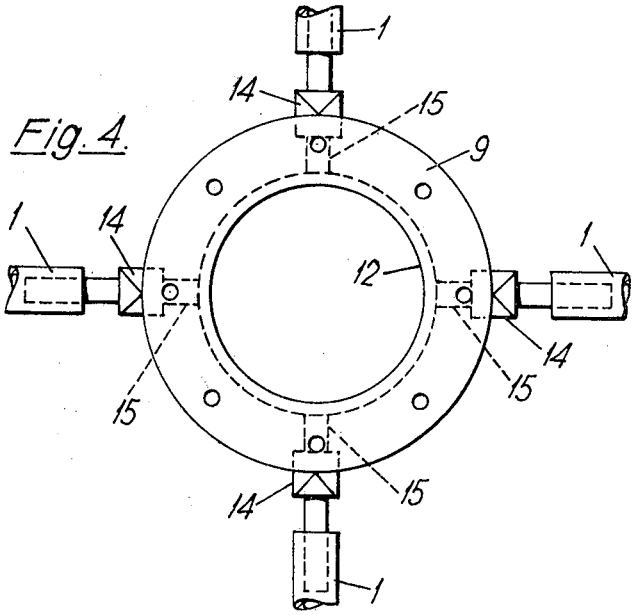
FIG. 4 is a plan diagrammatically illustrating another form of the apparatus.

In the embodiment of the apparatus diagrammatically illustrated in FIGS. 4 and 5, the inlet and outlet manifolds are formed by housings 11, 12 and each foam-forming pipe 1 extends laterally from a housing and is coiled, as at 13, between the ends thereof connected respectively to the inlet and the outlet housing.

Preferably, each pipe 1 is coiled at least at two locations 13 between the outlet manifold and the insert. The coiling considerably enhances foam stability.

In a preferred embodiment the housings 11, 12 are circular and the foam-forming pipes extend radially therefrom.

Each end of each of the foam-forming pipes is connected to a housing 11, 12 through a manually operable valve 14 connected to a stub pipe 15 extending laterally from the housing. The tubular inserts 2 (or 2*a*, 2*b*, or 2*c*) are, in this embodiment, connected to the valves 14 and the foam-forming pipes 1, which may be formed by flexible tubes, are fitted over the inserts 2 as illustrated in FIG. 5.

One end 16 of the inlet housing 11 is open to permit a dispersion of air and fibres in a liquid containing a surface active agent to flow into the housing and the end of the housing opposite said open end is closed by a plug, FIG. 5, having a conical configuration 17 extending into the housing to prevent the formation of air pockets in the inlet housing 11 and to provide substantially even flow through the foam-forming pipes 1. One end of the housing 12 is also open to permit the flow of foamed fibre dispersion from the housing.

With this embodiment there may be 48 foam-forming pipes 1 arranged in four ranks or banks each of twelve pipes and the housings 11, 12 are preferably independently supported so that little or no vibration is transmitted between the inlet and outlet manifolds. Generally before using the apparatus to make any particular kind of product the number of foam-forming pipes to be used will be selected by manipulation of the valve 14. If desired, the number of foam-forming pipes in use can also be changed during operation of the apparatus also by manipulation of the valves 14.

When the apparatus of FIGS. 4 and 5 is in operation a mixture of air, fibre, surface active agent, and liquid fed to the inlet manifold 11 is substantially equally divided into each foam-forming pipe 1 and the tubular inserts 2 (or 2*a*, 2*b*, 2*c*) set up turbulence in the mixture which effects the formation of a foamed fibre dispersion having desired properties as referred to above.

FIG. 6 diagrammatically illustrates the use of apparatus according to the invention in a non-woven fibrous material manufacturing system. The system includes a closed in-line mixer 18, for example a closed tank containing a rotatable paddle, in which an initial dispersion of air and fibre in liquid, usually water, containing a surface active agent is formed. From the mixer 18 the dispersion is fed under pressure, about 25 to 30 pounds per square inch, by a pump 19 to an input pipe 20 to the inlet manifold 2 or 11 as appropriate.

Foamed fibre dispersion leaves the outlet manifold 4 or 12 through an output pipe 23 and is fed on to a foraminous suspport 24 in the form of the wire of a Fourdrinier paper-making machine. The foamed fibre dispersion drains on the foraminous support 24 under the action of a vacuum applied to the underside of the support 24, the vacuum being provided by a vacuum system 25. Some of the liquid, which is generally in a foamed condition, drained from the foamed fibre dispersion on the foraminous support 24 is fed back by a pump 26 through a pipe 27 to the mixer 18 for re-use, and further fibre, either dry or as a dispersion, is fed into the mixer 18 through a pipe 28 for dispersion in the re-used liquid. Air under pressure is delivered to a metering device 21 by a compressor 22 or the like and the device 21 delivers metered quantities of air into the pipe 28. The amount of air supplied is indicated by the metering device 21 and is controlled so that the foamed fibre dispersion to be formed contains a required volume percentage of air such as will result in the formation of a foamed fibre dispersion having desired properties as described above.

The apparatus of the invention has been described above in relation to the production of a foamed fibre dispersion from an initially substantially un-foamed dispersion of fibres in a liquid containing a surface active agent and air; it will be appreciated that the mixer described with reference to FIG. 6 will effect some foaming of the mixture passing therethrough, the apparatus of the invention serving controllably to provide a foamed fibre dispersion having required properties.

Further, from the description of the re-use of liquid drained from the foamed fibre dispersion on the foraminous support, which liquid is generally in a foamed condition, it will also be appreciated that the apparatus of the invention, or the mixer described, can be supplied with a fibre dispersion in a foamed condition, albeit not in a foamed condition required for supply of the dispersion to the foraminous support.

It will be appreciated that although the undulating zones of alternately increasing and decreasing cross-section have been described in conjunction with inserts 2, 2*a*, 2*b*, and 2*c*, such zones need not be provided by inserts to realize advantages of aspects of the present invention, and accordingly such zones may be provided by establishing an undulating configuration of the pipe itself. In any event, in each pipe one or more internal regions of relatively short extent and defined by zones of alternately lesser and greater cross-section are provided. These regions may take the form shown in FIGS. 3 and 5 where the undulation is continuously sinusoidal-like in cross-section, the form of FIG. 7 where the undulation is continuously toothed, the form of FIG. 9 where the undulation is continuous and formed by converging and diverging frustoconical sections, the form of FIG. 8 where the undulation is discontinuous and formed by converging and diverging frustoconical sections, or other suitable forms. The undulations may be symmetrical as depicted or may be assymmetrical and a combination of undulation profiles with or without discontinuity may be employed.

Generally, lengths of the undulation region in the range of 3 to 13 mm, preferably 10 mm, are preferred, and differences in the narrowest cross-sectional dimension and the greatest cross-sectional dimension in the range of 1 to 4 mm, preferably 3 mm are preferred.

I claim:

1. Apparatus for producing a foamed fibre dispersion for deposition on the foraminous support of a machine for manufacturing non-woven fibrous material, said apparatus comprising an outlet manifold closed except for an outlet from which foamed fibre dispersion issues for deposition on the foraminous support and a plurality of input openings, an inlet manifold closed except for an inlet through which the apparatus is supplied with dispersion to be foamed and a plurality of outlet openings, a plurality of closed foam-forming pipes each effecting communication between an individual one of the inlet manifold outlets and an individual one of the outlet manifold inlet openings, each said foam-forming pipe including at least one internal region defined by zones of alternately decreasing and increasing cross section so as to establish cross sectional restriction to increase the speed of flow of dispersion thereby to create in the foam-forming pipe turbulence to effect foaming of the dispersion, and a pump operable to pump a dispersion of air and fibres in a liquid containing a surface active agent into and through the inlet manifold, through the foam-forming pipes, and into and out of the outlet manifold.

2. Apparatus according to claim 1, wherein said at least one internal region is located adjacent to the position of connection of the pipe to the inlet manifold.

3. Apparatus according to claim 1, wherein said at least one internal region is formed by a tubular insert located in a foam-forming pipe.

4. Apparatus according to claim 1, wherein the inlet and outlet manifolds are formed respectively by an inlet pipe and an outlet pipe and the foam-forming pipes are straight pipes extending between the inlet and outlet pipes in spaced substantially parallel relation.

5. Apparatus according to claim 4, wherein bossed flanged members are secured to each of the inlet and outlet pipes, and one end of a foam-forming pipe is located in the boss of each said member and is secured therein by two coacting sleeves one within the other, the inner sleeve being secured to said pipe and to the outer sleeve, and the outer sleeve being secured to the boss of said member.

6. Apparatus according to claim 1, wherein at least some of the foam-forming pipes are provided with on/-off valves to control the through-put of the apparatus.

7. Apparatus according to claim 1, wherein the inlet and outlet manifolds are each formed by a housing, each foam-forming pipe extends laterally therefrom and is coiled between the ends thereof connected respectively to the inlet and the outlet housing, one end of the inlet housing is open to permit air and a dispersion of air and fibres in a liquid containing a surface active agent to flow into the housing, and the outlet housing has an open end to permit the flow of foamed fibre dispersion therefrom.

8. Apparatus according to claim 7, wherein each foam-forming pipe is coiled at least at two locations between the ends thereof connected to the inlet and the outlet housing.

9. Apparatus according to claim 8, wherein each foam-forming pipe is connected to the inlet housing through a manually operable valve.

10. Apparatus according to claim 8, wherein the end of the inlet housing opposite the open end thereof is closed by a plug having a conical configuration extending into the housing to prevent the formation of air pockets in the inlet housing.

11. Apparatus according to claim 10, wherein the inlet manifold is connected through a delivery pipe with a mixer arranged to effect an initial dispersion of air and fibres in liquid containing a surface active agent, wherein the pump is connected to the delivery pipe between the inlet manifold and the mixer, and wherein metering means is connected with an inlet to the mixer to admit thereto metered quantities of air.

12. Apparatus according to claim 11, including a vacuum system operable to remove liquid from foamed fibre dispersion on the foraminous support and a pump and return pipe arranged to return to the mixer liquid removed from the foamed fibre dispersion on the foraminous support.

13. Apparatus according to claim 8, wherein the opposite ends of each foam-forming pipe are connected respectively one to the inlet housing and one to the outlet housing through manually operable valves connected to stub pipes extending laterally from the housings.

14. Apparatus according to claim 13, wherein the end of each foam-forming pipe connected to the inlet housing is fitted over a tubular insert connected to one of said valves.

15. Apparatus according to claim 13, wherein the inlet manifold is connected through a delivery pipe with a mixer arranged to effect an initial dispersion of air and fibres in liquid containing a surface active agent, wherein the pump is connected to the delivery pipe between the inlet manifold and the mixer, and wherein metering means is connected with an inlet to the mixer to admit thereto metered quantities of air.

16. Apparatus according to claim 15, including a vacuum system operable to remove liquid from foamed fibre dispersion on the foraminous support and a pump and return pipe arranged to return to the mixer liquid removed from the foamed fibre dispersion on the foraminous support.

17. Apparatus according to claim 7, wherein the housings are circular and the connections of the foam-forming pipes thereto extend radially therefrom.

18. Apparatus according to claim 7, wherein the inlet manifold is connected through a delivery pipe with a mixer arranged to effect an initial dispersion of air and fibres in liquid containing a surface active agent, wherein the pump in connected to the delivery pipe between the inlet manifold and the mixer, and wherein metering means is connected with an inlet to the mixer to admit thereto metered quantities of air.

19. Apparatus according to claim 18, including a vacuum system operable to remove liquid from foamed fibre dispersion on the foraminous support and a pump and return pipe arranged to return to the mixer liquid removed from the foamed fibre dispersion on the foraminous support.

20. Apparatus according to claim 1, wherein the inlet manifold is connected through a delivery pipe with a mixer arranged to effect an initial dispersion of air and fibres in liquid containing a surface active agent, wherein the pump is connected to the delivery pipe between the inlet manifold and the mixer, and wherein metering means is connected with an inlet to the mixer to admit thereto metered quantities of air.

21. Apparatus according to claim 20, including a vacuum system operable to remove liquid from foamed fibre dispersion on the foraminous support and a pump and return pipe arranged to return to the mixer liquid removed from the foamed fibre dispersion on the foraminous support.

22. Apparatus comprising a plurality of pipes connecting an inlet manifold to an outlet manifold each pipe including between the inlet and outlet manifolds at least one internal portion consisting of a succession of zones of short extent and alternate lesser and greater cross section which when a dispersion of air and fibres in a liquid containing a surface active agent is fed under pressure from the inlet manifold effect foaming of the dispersion for delivery to the outlet manifold, each said pipe between the outlet manifold and said internal portion of the pipe being provided with a coiled portion for enhancing foam stability.

23. Apparatus according to claim 22, wherein said coiled portion comprises at least two coiled sections.

* * * * *